US008303393B2

(12) United States Patent
Jaffe et al.

(10) Patent No.: US 8,303,393 B2
(45) Date of Patent: Nov. 6, 2012

(54) WAGERING GAME WITH ENHANCED BONUS FEATURE

(75) Inventors: Joel R. Jaffe, Glenview, IL (US); Noel S. Steere, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 154 days.

(21) Appl. No.: 12/739,891

(22) PCT Filed: Nov. 5, 2008

(86) PCT No.: PCT/US2008/082394

§ 371 (c)(1),
(2), (4) Date: Apr. 26, 2010

(87) PCT Pub. No.: WO2009/061757

PCT Pub. Date: May 14, 2009

(65) Prior Publication Data

US 2010/0248811 A1 Sep. 30, 2010

Related U.S. Application Data

(60) Provisional application No. 61/002,053, filed on Nov. 6, 2007.

(51) Int. Cl.
*A63F 9/24* (2006.01)

(52) U.S. Cl. ..... 463/16; 463/20; 463/25; 463/29

(58) Field of Classification Search ..... 463/16
See application file for complete search history.

(56) References Cited

U.S. PATENT DOCUMENTS 5,209,479 A 5/1993 Nagao et al.
5,580,053 A 12/1996 Crouch
5,611,535 A 3/1997 Tiberio
5,947,820 A 9/1999 Morro et al.
6,186,894 B1 2/2001 Mayeroff
6,224,483 B1 5/2001 Mayeroff
6,231,442 B1 5/2001 Mayeroff
6,270,412 B1 * 8/2001 Crawford et al. ..... 463/20
6,932,702 B1 8/2005 Harris
7,070,503 B2 7/2006 Rudolph
7,192,343 B2 3/2007 Vancura
7,439,279 B2 10/2008 Kondo et al.
7,494,413 B2 2/2009 Singer et al.
7,601,061 B2 10/2009 Jackson
7,601,062 B2 10/2009 Cole et al.

(Continued)

OTHER PUBLICATIONS

Written Opinion corresponding to International Patent Application No. PCT/US2008/082394, United States Patent Office, dated Jan. 6, 2009, 5 pages.

(Continued)

*Primary Examiner* — Omkar Deodhar

(74) *Attorney, Agent, or Firm* — Nixon Peabody LLP

(57) ABSTRACT

A gaming system includes at least one display configured to display a plurality of symbols positions. The plurality of symbol positions are configured to display symbols indicative of a randomly selected outcome of a wagering game in relation to a plurality of paylines. The gaming system further includes a controller configured to award an award for any winning outcome occurring along a payline and to add a number of winning paylines to a counter configured to track a number of winning paylines. The controller is further configured, in response to a number of winning paylines in the counter exceeding a predetermined threshold number, to activate a game feature in which a second award is awarded.

24 Claims, 9 Drawing Sheets

U.S. PATENT DOCUMENTS

| | | | | |
|---|---|---|---|---|
| 2005/0054429 | A1* | 3/2005 | Baerlocher et al. | 463/25 |
| 2006/0030396 | A1 | 2/2006 | Marks et al. | |
| 2006/0189380 | A1 | 8/2006 | Schultz et al. | |
| 2007/0129134 | A1 | 6/2007 | Barrie | |
| 2007/0167223 | A1 | 7/2007 | Bleich et al. | |
| 2007/0173315 | A1 | 7/2007 | Law | |
| 2007/0293293 | A1* | 12/2007 | Baerlocher et al. | 463/16 |
| 2008/0113735 | A1* | 5/2008 | Maya | 463/20 |
| 2009/0197684 | A1* | 8/2009 | Arezina et al. | 463/42 |
| 2009/0247263 | A1 | 10/2009 | Inamura | |

OTHER PUBLICATIONS

International Search Report corresponding to International Patent Application No. PCT/US2008/082394, United States Patent Office, dated Jan. 6, 2009, 2 pages.

* cited by examiner

WAGERING GAME WITH ENHANCED BONUS FEATURE

CLAIM OF PRIORITY AND CROSS-REFERENCE TO RELATED APPLICATIONS

This application is a U.S. National Phase of International Application No. PCT/US2008/082394, filed on Nov. 5, 2008, which claims the benefit of and priority to U.S. Provisional Patent Application No. 61/002,053, filed on Nov. 6, 2007, both of which are incorporated herein by reference in their entireties.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines and methods for playing wagering games and, more particularly, to a wagering game having an enhanced bonus feature.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

SUMMARY OF THE INVENTION

According to one aspect of the present invention, a gaming system includes at least one display configured to display a plurality of symbols positions. The plurality of symbol positions are configured to display symbols indicative of a randomly selected outcome of a wagering game in relation to a plurality of paylines. The gaming system further includes a controller configured to award an award for any winning outcome occurring along a payline and to add a number of winning paylines to a counter configured to track a number of winning paylines. The controller is further configured, in response to a number of winning paylines in the counter exceeding a predetermined threshold number, to activate a game feature in which a second award is awarded.

According to another aspect of the invention, a method of conducting a wagering game on a gaming system comprises displaying a first array of randomly selected symbols. The first array of randomly selected symbols forms an outcome in a wagering game. The method further comprises evaluating the first array of symbol positions for a predetermined triggering condition. The method further comprises displaying, in response to the occurrence of the predetermined triggering condition in the first array, a second array of symbols comprising a cluster of common symbols. The method further comprises awarding an award associated with the amount of winning paylines occurring at least in association with the cluster of common symbols.

According to another aspect of the invention, a method of conducting a wagering game on a gaming system comprises displaying a plurality of reels having a plurality of standard symbols for indicating a randomly selected outcome of the wagering game. The plurality of reels forms an array. The method further comprises, in response to a predetermined event, modifying a cluster of adjacent symbols within the array such that the cluster includes like standard symbols.

According to another aspect of the invention, a method of conducting a wagering game on a gaming system comprises displaying an array of symbol positions configured to indicate a randomly selected outcome of the wagering game. The method further comprises populating the plurality of symbol positions with symbols corresponding to the randomly selected outcome. The method further comprises awarding an award if the symbols populating the array of symbol positions correspond to a winning outcome. The method further comprises evaluating the array of symbol positions for a predetermined triggering condition. The method further comprises modifying, in response to a satisfaction of the predetermined triggering condition, a plurality of symbols positions adjacent a selected symbol position to display a common symbol. The method further comprises evaluating the modified array of symbol positions to determine a number winning of paylines indicated by the modified array. The method further comprises awarding an award relating to the indicated number of paylines.

According to yet another aspect of the invention, a computer readable storage medium is encoded with instructions for directing a gaming system to perform the above methods.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
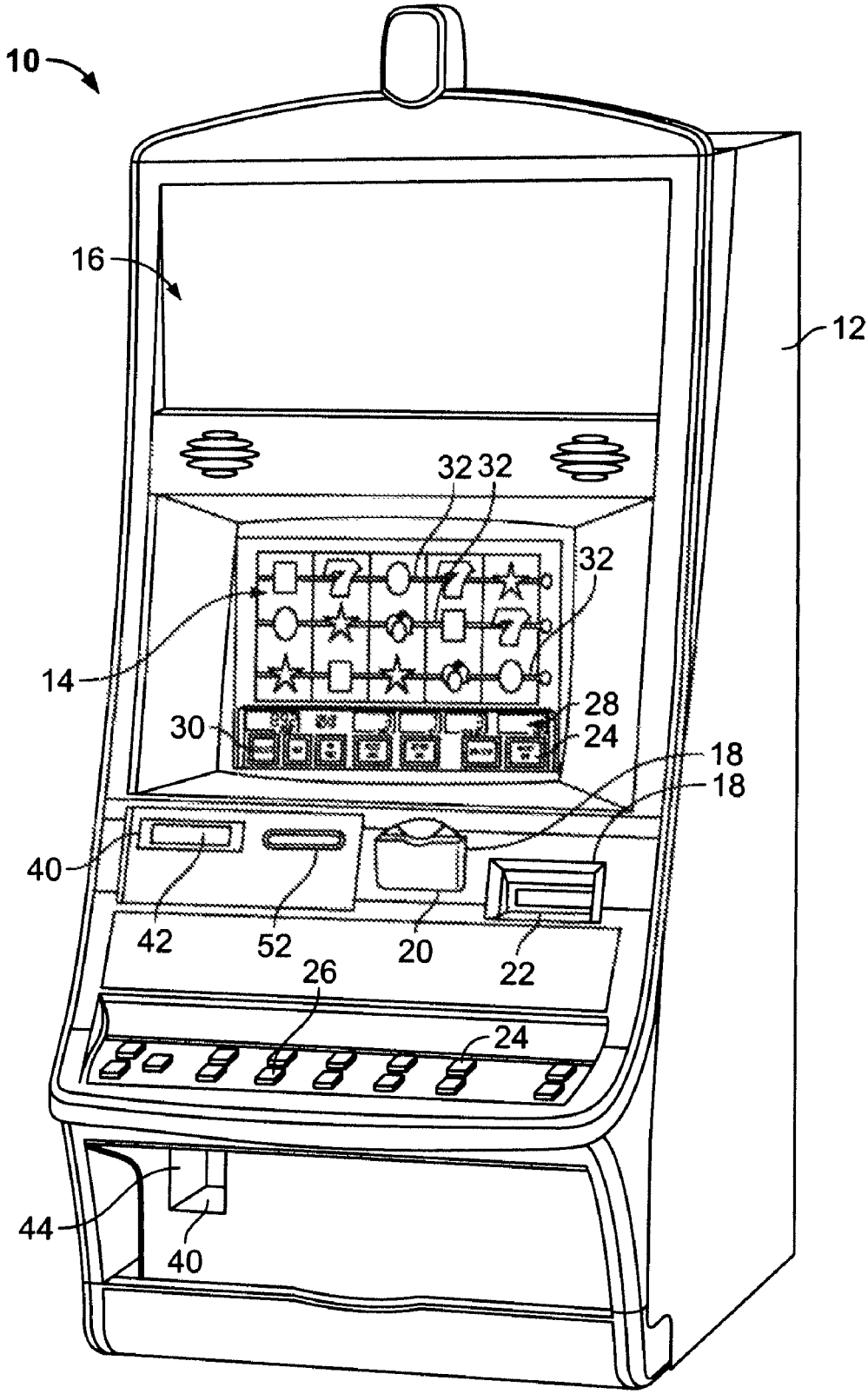
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
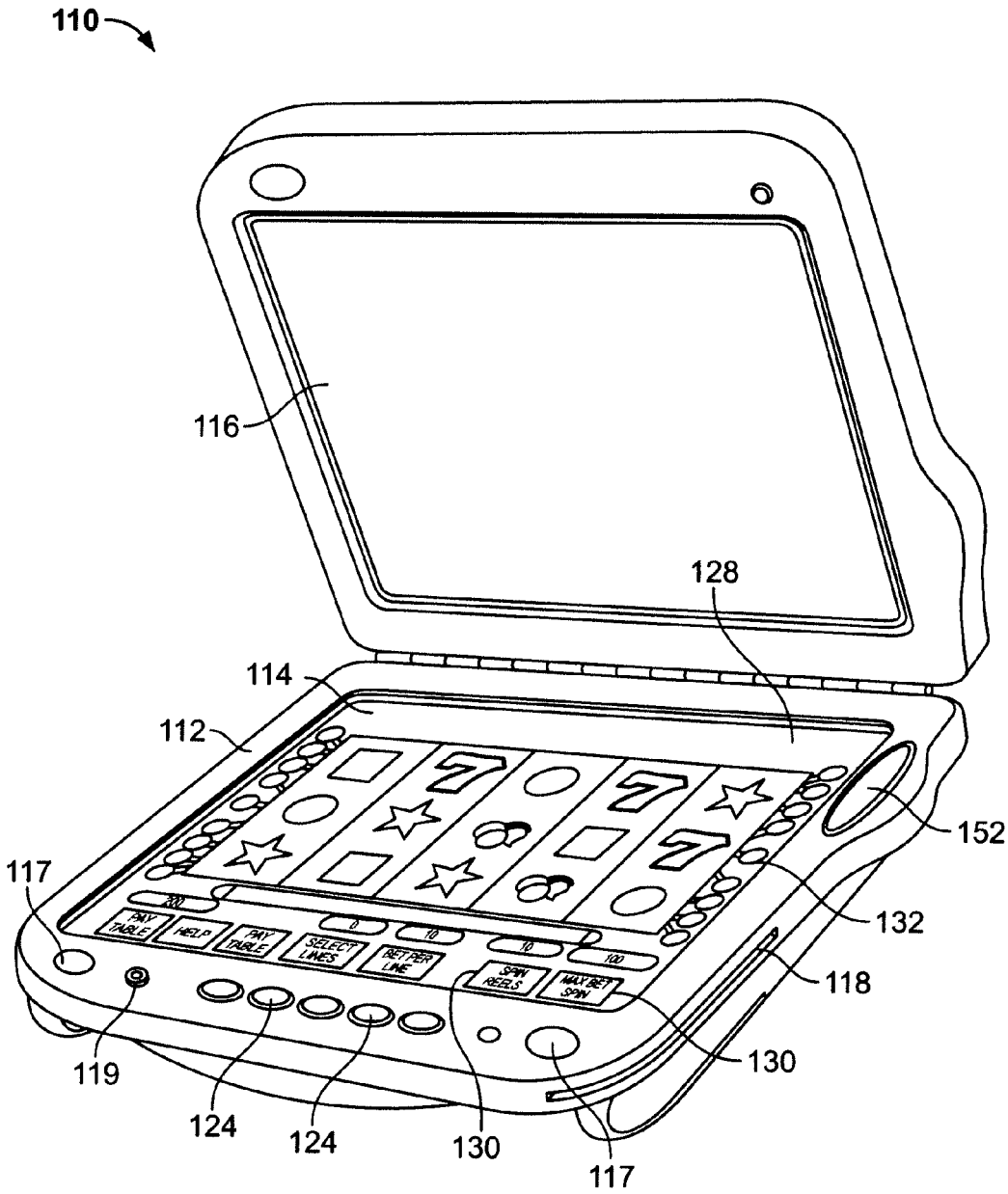
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, blackjack, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
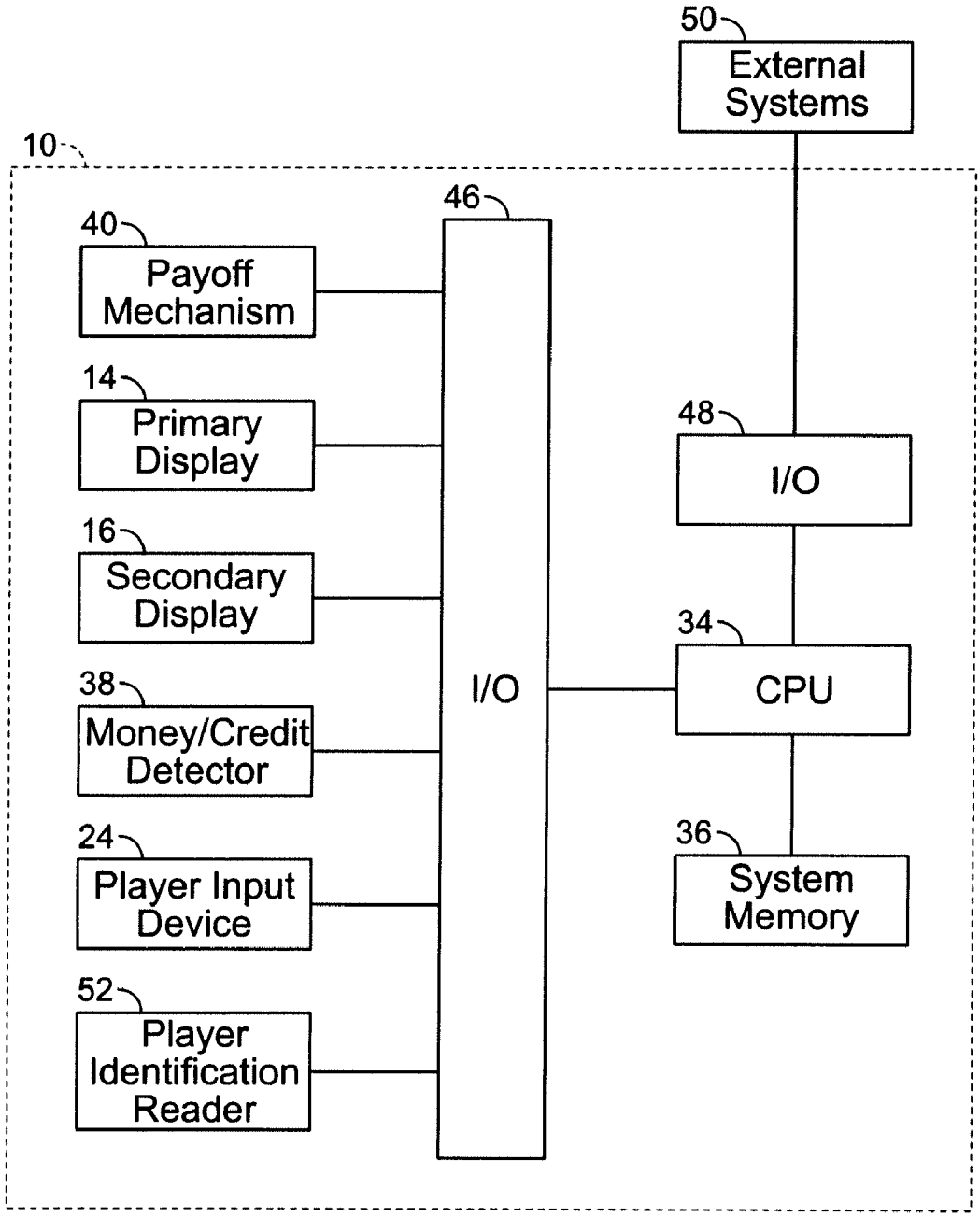
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality therebetween (e.g., a "rich client"). As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "rich client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Security features are advantageously utilized where the gaming machines 10,110 communicate wirelessly with external systems 50, such as through wireless local area network (WLAN) technologies, wireless personal area networks (WPAN) technologies, wireless metropolitan area network (WMAN) technologies, wireless wide area network (WWAN) technologies, or other wireless network technologies implemented in accord with related standards or protocols (e.g., the Institute of Electrical and Electronics Engineers (IEEE) 802.11 family of WLAN standards, IEEE 802.11i, IEEE 802.11r (under development), IEEE 802.11w (under development), IEEE 802.15.1 (Bluetooth), IEEE 802.12.3, etc.). For example, a WLAN in accord with at least some aspects of the present concepts comprises a robust security network (RSN), a wireless security network that allows the creation of robust security network associations (RSNA) using one or more cryptographic techniques, which provides one system to avoid security vulnerabilities associated with IEEE 802.11 (the Wired Equivalent Privacy (WEP) protocol). Constituent components of the RSN may comprise, for example, stations (STA) (e.g., wireless endpoint devices such as laptops, wireless handheld devices, cellular phones, handheld gaming machine 110, etc.), access points (AP) (e.g., a network device or devices that allow(s) an STA to communicate wirelessly and to connect to a(nother) network, such as a communication device associated with I/O circuit(s) 48), and authentication servers (AS) (e.g., an external system 50), which provide authentication services to STAs. Information regarding security features for wireless networks may be found, for example, in the National Institute of Standards and Technology (NIST), Technology Administration U.S. Department of Commerce, Special Publication (SP) 800-97, Establishing Wireless Robust Security Networks: A Guide to IEEE 802.11, and SP 800-48, Wireless Network Security: 802.11, Bluetooth and Handheld Devices, both of which are incorporated herein by reference in their entirety.

Figure 3:
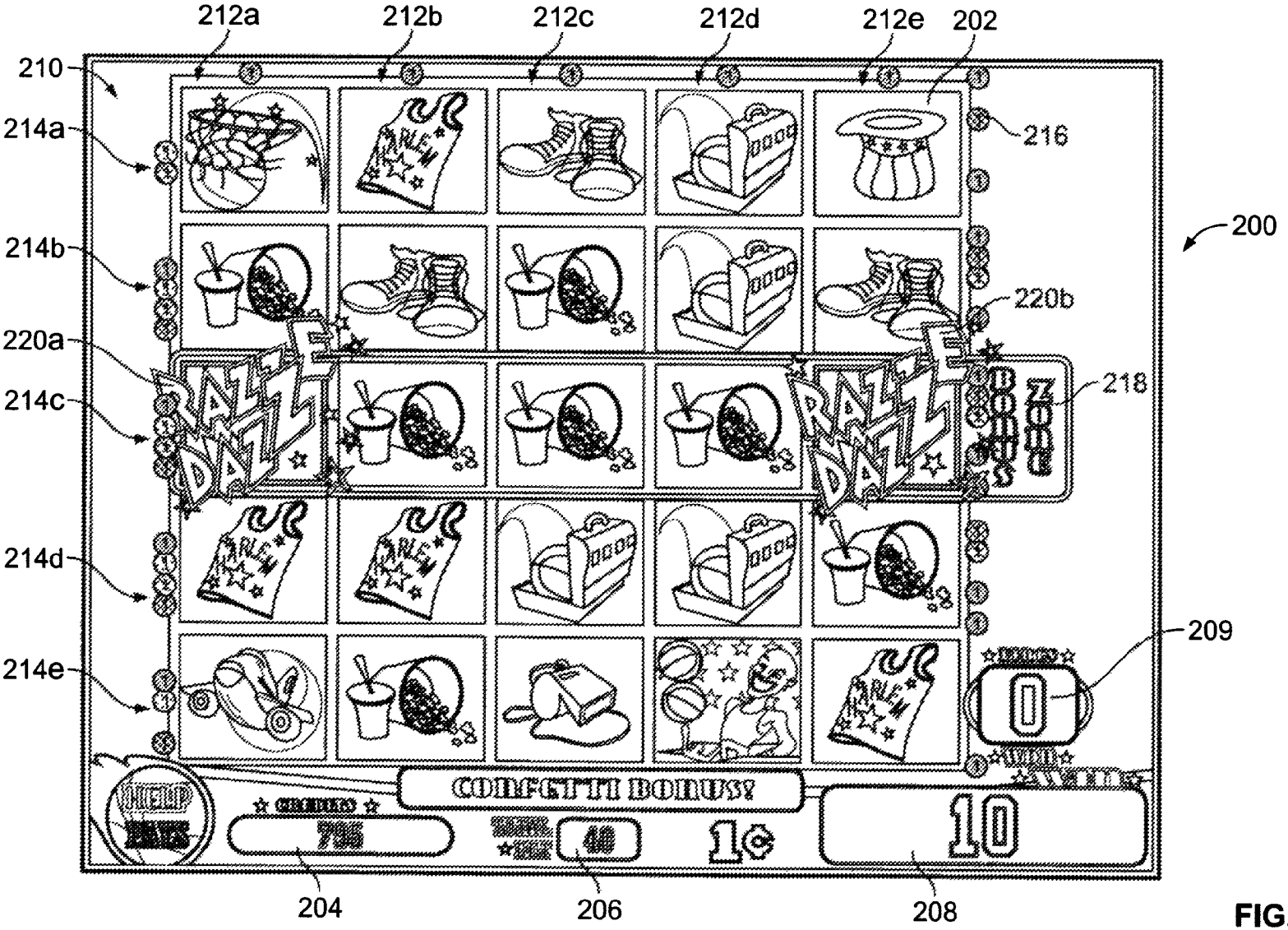
FIG. 3 is an illustration of a main game screen incorporating one embodiment of the present invention.

Turning now to FIG. 3, an image of a main game screen 200 according to one embodiment of the present invention is illustrated. A player may begin play of a basic wagering game by inserting a wager into the value input device 18 of the gaming machine 10. The player may select play by using the player input device 24, via the buttons 26 or the touch screen keys 30, which are shown in FIGS. 1*a*, 1*b*. The CPU 34 (or a controller in the wagering game control network in alternative embodiments) operates to execute a wagering game program causing the primary display 14 to display the wagering game that includes a plurality of visual elements.

The game screen 200 may be displayed on the primary display 14, the secondary display 16, or on a portion(s) thereof. In the illustrated embodiment, the game screen 200 is used to display a plurality of simulated, movable independent reels 202. As shown, the independent reels 202 display a single symbol while at rest. It should be noted, however, that each of the independent reels 202 include a plurality of symbols capable of being displayed thereon.

The basic game screen 200 may also display a plurality of game session meters and various buttons selectable by a player. The game session meters may include a "credit" meter 204 for displaying a number of credits available for play on the machine, a "total bet" meter 206 for displaying a total number of credits wagered for the particular round of wagering, a "win" meter 208 for displaying an amount to be awarded based on the results of the particular wager, and a "lines won" meter 209 for displaying an amount of winning paylines achieved. The "lines won" meter 209 may be reset to zero in between each reel spin, thereby displaying only the amount of paylines won during the current spin of the reels. In other embodiments, e.g., where more than one free spin has been awarded, the "lines won" meter 209 may display the total amount of winning paylines achieved during all of the free spins. Thus, for example, if five free spins were awarded, the "lines won" meter 209 would display the total amount of winning paylines achieved during all five of the free spins. In still other embodiments, the "lines won" meter 209 may only be reset to zero prior to each new basic game being played, a new wager being wagered, or the like. In such an embodiment, the "lines won" meter 209 displays the total amount of paylines achieved during the basic game, the bonus games(s), and the free spin(s).

Although not shown in the embodiment of FIG. 3, the basic game screen 200 may also include player-selectable buttons including, but not limited to, a "spin reels" button for moving the reels 202, a "max bet spin" button for wagering a maximum number of credits and moving the reels 202 of the wagering game, and/or a "collect" button to collect the credits remaining in the credit meter 204. While the gaming machine 10, 110 allows for these types of player inputs, the present invention does not require them and can be used on gaming machines having more, less, or different player inputs.

In FIG. 3, a 5×5 array of symbols 210 including five columns 212*a-e* and five rows 214*a-e* is illustrated. However, there may be more or less columns 212 and/or rows 214 in accordance with other embodiments of the present invention. In the embodiment of FIG. 3 the array 210 includes a plurality of independent reels 202. Other embodiments may include multi-symbol reels or a combination of multi-symbol reels and independent reels. The multi-symbol reels and/or the independent reels may be either traditional mechanical reels, or they may be video reels having computer-generated images. The video reels may simulate movement of the symbols positioned on the reels.

The plurality of symbols displayed on the array 210 are used to indicate a plurality of possible outcomes along paylines 216. The depicted symbols all correspond to a "HARLEM GLOBETROTTERS" theme and include various symbols associated with the theme. Other HARLEM GLOBETROTTER themed symbols may also be depicted. In other embodiments, the gaming machine 10, 110 may portray other themes with corresponding like-themed symbols. Further, standard gaming symbols such as "1-BAR" symbols, "2-BAR" symbols, "3-BAR" symbols, "CHERRY" symbols, "7" symbols, "BELL" symbols, or the like may be depicted on the reels 202.

The wagering game of one embodiment of the present invention includes an enhanced bonus game. The enhanced bonus game includes a "confetti bonus," where a block or "cluster" of symbols (e.g., a 3×3 sub-array) adjacent to one another display common or like standard symbols resulting in a modified array. The standard symbols have a single functionality to indicate a predefined winning amount in a pay table. Thus, standard symbols include symbols other than progressive symbols, bonus-triggering symbols, wild symbols, and the like. The modified array is then evaluated to determine whether additional winning outcomes have been achieved.

Alternatively or additionally, the wagering game of the embodiments of the present invention may include an enhanced payline-payout feature, referred to herein as a top box bonus feature. The top box bonus feature may award an additional bonus award to a player who achieves a predetermined amount of winning paylines. Winning payline-payouts are listed in a pay table. The winning payline-payouts may, for example, include 19-20 winning paylines yielding a first payout, 21-22 paylines yielding a second, larger payout, 23-24 winning paylines yielding a third, even larger payout, etc.

Referring back to FIG. 3, once a player has placed a wager, the player may spin the reels (e.g., by pressing a "spin reels" button). The reels 202 then begin to move (e.g., spin) and come to rest displaying symbols indicating a randomly selected outcome. The randomly selected outcome may then be compared to a pay table to determine whether any of the activated pay lines include winning symbols or symbol combinations.

Winning outcomes including like-symbol combinations are listed in a pay table. Winning outcomes listed in the pay table may include a three like-symbol combination yielding a first payout, a four like-symbol combination yielding a second, larger payout, a five like-symbol combination yielding a third, even larger payout, etc.

Pay tables may be stored in the system memory 36 of the gaming machine 10, 110. The pay tables may also be displayed on the primary display 14, the secondary display 16, or both and may be displayed constantly, intermittently, or upon request by a player.

In one embodiment, any WILD symbol occurring during the basic game, bonus game, and/or free spins becomes "locked" in place. This feature may be particularly desirable in embodiments where independent reels are utilized. In this embodiment, the reels displaying non-WILD symbols are respun while those displaying WILD symbols are locked (i.e., not respun). The WILD symbols may remain locked until the game (e.g., basic game, bonus game, free spin) is completed.

The array 210 of FIG. 3 includes a bonus zone 218. The bonus zone 218 may be highlighted by an outline, by appearing brighter than other rows, columns, or the like, or by any other suitable manner. In the illustrated embodiment, the bonus zone 218 includes the reels 202 positioned in the middle row 214*c*. In other embodiments, however, the bonus zone may include other reels, rows, columns, or combinations thereof.

If the bonus zone 218 includes a predetermined symbol or combination of symbols, a "confetti bonus" may be triggered. As illustrated in FIG. 3, because the randomly selected outcome includes RAZZLE DAZZLE symbols 220*a,b* in the first and fifth columns 212*a,e* of the bonus zone 218, the array 210 is evaluated for winning paylines, corresponding awards (if any) are awarded, and the confetti bonus is then activated.

The confetti bonus may be triggered in any suitable way. For example, the confetti bonus may be triggered by a predetermined symbol or combination of symbols appearing in a particular position or reel of the array, a predetermined symbol or combination of symbols being positioned anywhere on the array, etc. The confetti bonus may also be randomly triggered. If a free spin bonus is triggered at the same time a confetti bonus is triggered (e.g., during the same reel spin), the free spins occur after the confetti bonus is complete.

Figure 4:
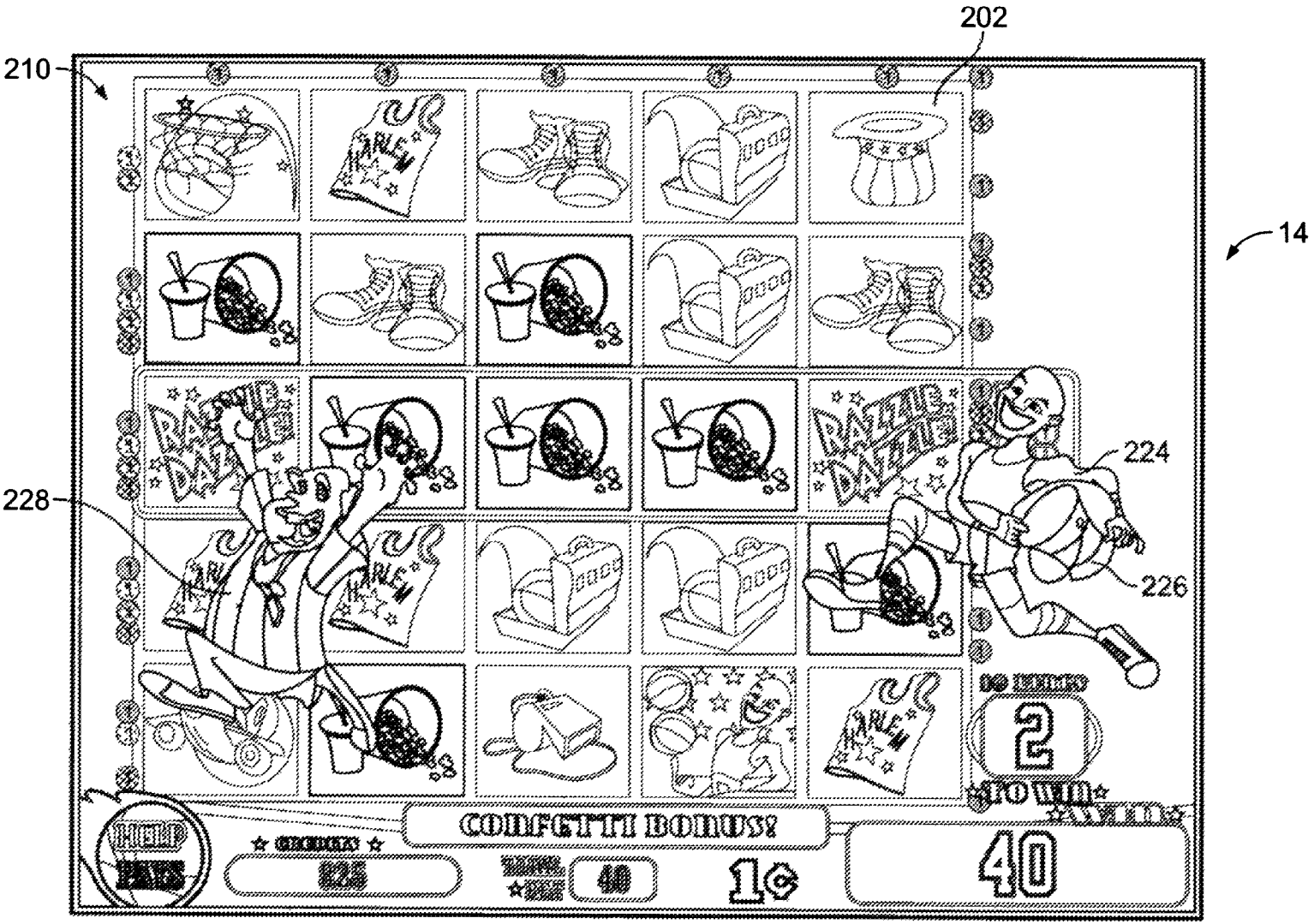
FIG. 4 is an illustration of a bonus animation incorporating one embodiment of the present invention.
Figure 5:
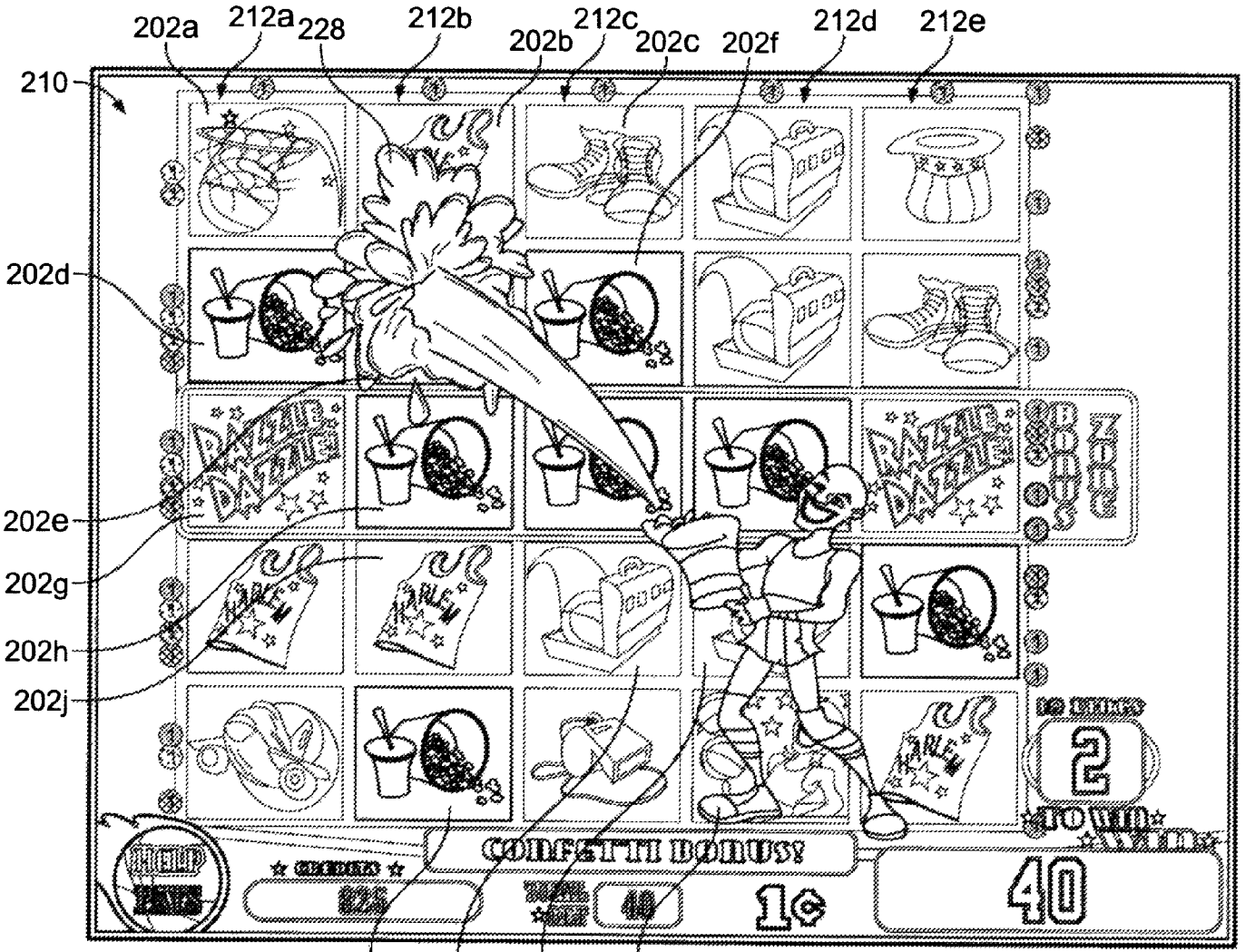
FIG. 5 is an illustration of a bonus animation subsequent to the screen of FIG. 4.
Figure 6:
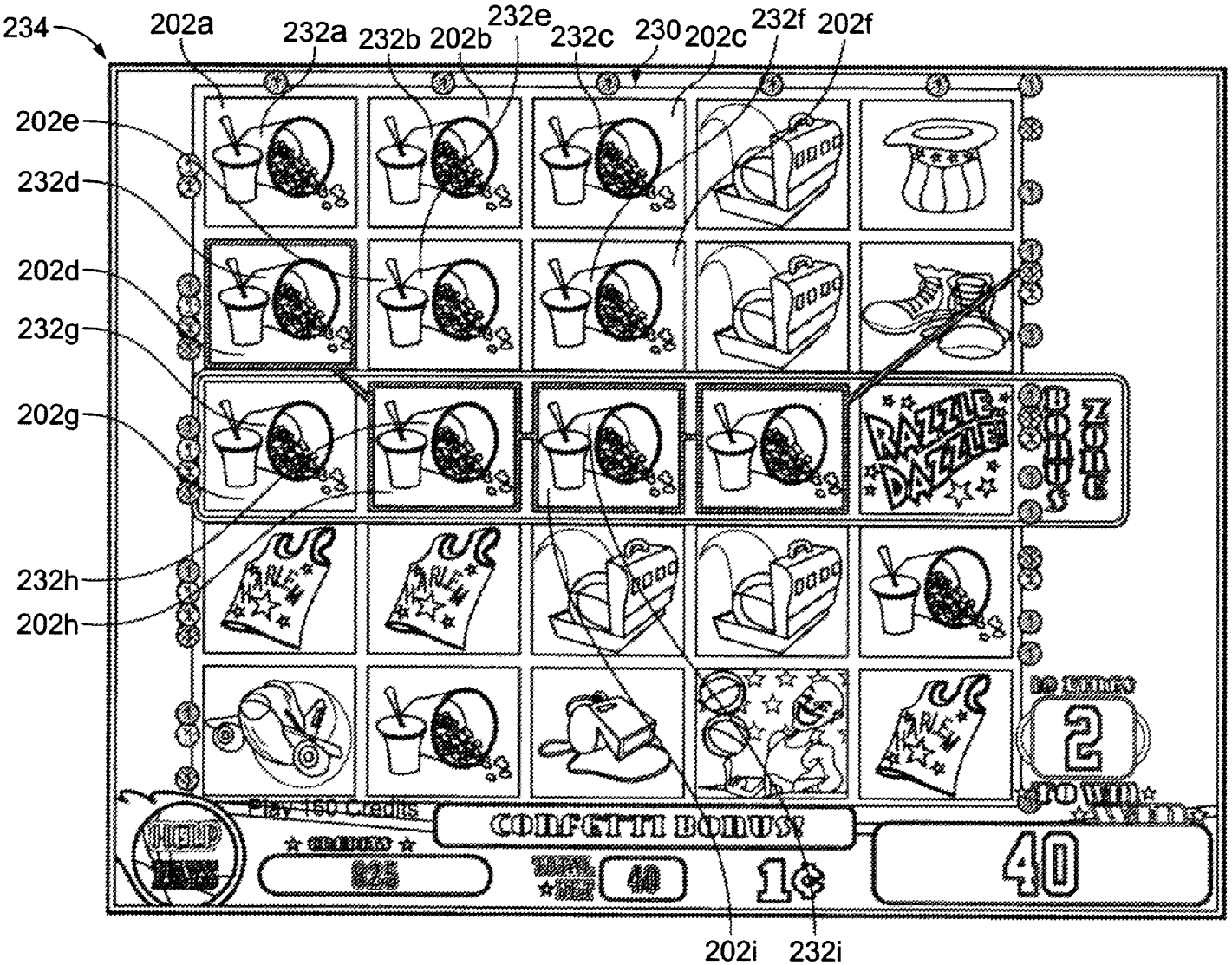
FIG. 6 is an illustration of a bonus game screen subsequent to the screen of FIG. 5.

Once the confetti bonus is triggered, an animation may be shown on the display 14, as illustrated, for example, in FIG. 4. In FIG. 4, the animation includes a Globetrotter 224 holding a bucket 226 and chasing a referee 228 across the reels 202. As shown in FIG. 5, the Globetrotter 224 then tosses the contents 228 of the bucket 226—e.g., confetti or water—onto a random symbol/reel of the array 210. In the illustrated embodiment, the contents 228 of the bucket 226 are tossed onto the reel 202*e*, and all of the reels 202*a-d*, 202*f-i* adjacent to the reel 202*e* become "wet." The "wet" reels of the illustrated embodiment form a 3×3 sub-array or "cluster" 230. The "wet" reels 202*a-i* included in the 3×3 cluster 230 are then modified to display like symbols. Referring to FIG. 6, for example, all of the "wet" reels 202*a-i* of the 3×3 cluster 230 display POPCORN symbols 232*a-i*, thereby forming a modified array 234.

The contents 228 of the bucket 226 may be tossed on any number of reels or symbols positioned in any suitable location in the array 210. For example, the "wet" reels/symbols may form a 2×2 array, a 2×5 array, a 4×3 array, or the like. In other embodiments, the "wet" reels/symbols may form an uneven array. Referring to FIG. 5, such an uneven array may include independent reels 202*a-m*. The "wet" reels/symbols may also be in scattered positions on the array 210. In one embodiment, the contents 228 of the bucket 226 may be shown to "drip" down one or more columns 212*a-e*. In such an embodiment, the topmost "wet" reel(s)/symbol(s) may be modified to display like symbols, followed by a reel(s)/symbol(s) positioned underneath one or more of the topmost reel(s)/symbol(s), etc., thereby illustrating a "dripping" effect.

The type of symbol (e.g., POPCORN symbol 232) that the reels in the cluster 230 are modified to display may be determined in any suitable way. For example, the type of symbol may be chosen randomly, based on the symbol type that is most beneficial to a player, a weighting of adjacent symbols, or the like.

The resulting outcome indicated by the symbols on the modified array 234 is then evaluated to determine whether any additional winning outcomes (e.g., winning paylines) have occurred. As shown in the "lines won" meter 209 of FIG. 7, the modified array 234 includes twenty (20) winning paylines 216.

In one embodiment, one or more supplemental modifications to the array may be made. The supplemental modification may be random or based on some predetermined condition. In one embodiment, for example, the Globetrotter 224 may reappear either before or after the modified array 234 is evaluated to add one or more additional like symbols (e.g., POPCORN symbol 232) to the modified array 234. The Globetrotter 224 may do so by "splashing" an additional symbol(s)/reel(s) with more confetti or water. Another animation (or no animation) may also be used to add the additional like symbol(s).

According to one embodiment, achieving a predetermined amount or combination of symbols (e.g., three RAZZLE DAZZLE symbols 220 positioned in the bonus zone 218) yields one or more free spins. The number of free spins may depend on the number of RAZZLE DAZZLE symbols achieved. For example, three RAZZLE DAZZLE symbols 220 may yield 10 free spins, four RAZZLE DAZZLE symbols 220 may yield 15 free spins, and five RAZZLE DAZZLE symbols 220 may yield 25 free spins. Achieving three or more RAZZLE DAZZLE symbols 220 during the free spins may add additional free spins to the amount of free spins remaining. Confetti bonuses achieved during the free spins may yield larger like-symbol clusters (e.g., more symbols/reels may become "wet"), thereby increasing the probability of winning paylines being achieved. The confetti bonus may also occur more or less frequently during the free spins.

An alternate set of reels may be used during the free spins. Winning combinations and the bet per line for the alternate set of reels may be identical to those in the basic game. The active paylines in the alternate set of reels may be the same as those of the spin that triggered the free spin. The alternate set of reels may alter the probability of a player achieving a particular winning combination. For example, the alternate set of reels may increase the probability of a player achieving a symbol combination associated with lower award values and decrease the probability of a player achieving a symbol combination associated with higher award values or vice versa.

Figure 7:
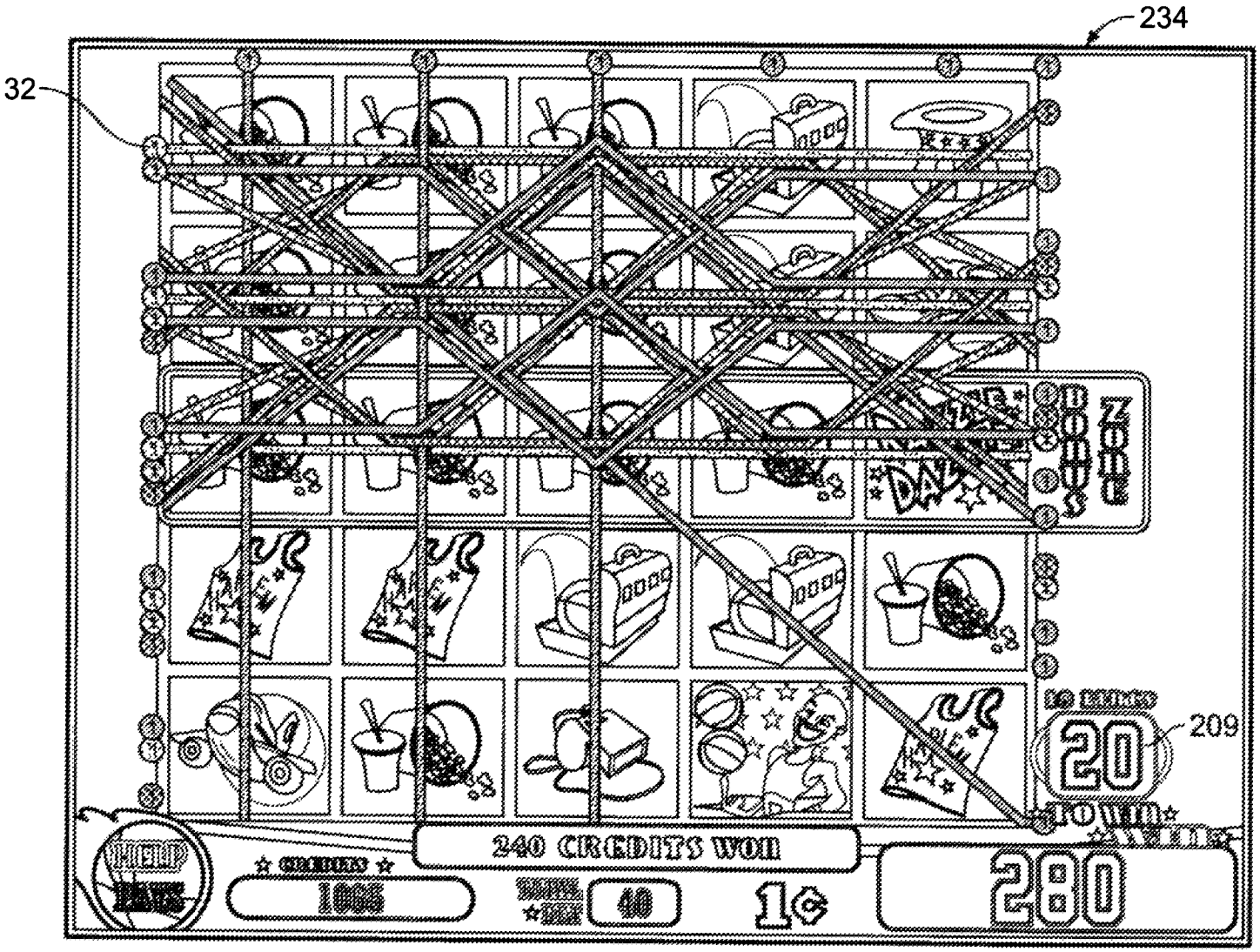
FIG. 7 is an illustration of a bonus game screen subsequent to the screen of FIG. 6.

According to one embodiment, the player may be awarded an additional payline-payout bonus for achieving a predetermined number of winning paylines 216. Although referred to herein as a "top box bonus," the additional payline-payout bonus may be achieved and/or displayed on the primary display 14, the secondary display 16, or combinations thereof. In the illustrated embodiments, the top box bonus feature is triggered by achieving nineteen or more winning paylines during the basic game, the confetti bonus feature, or the free spins. The number of winning paylines may include paylines having any winning symbol combination. Thus, it is not necessary that all of the winning paylines include, e.g. winning combinations of POPCORN symbols. Referring to FIG. 7, for example, the player is eligible for the top box bonus because a combined total of twenty winning paylines were achieved during the basic game and the confetti bonus. More specifically, two winning paylines were achieved during the basic game (see FIGS. 4-6), and an additional eighteen winning paylines were achieved during the confetti bonus (see FIG. 7). In other embodiments, the amount of winning paylines required to trigger the top box bonus may be based only on those achieved during the basic game, those achieved during the confetti bonus, those achieved during the free spins, or combinations thereof.

In some embodiments, the number of winning paylines that trigger the top box bonus may be based on more than one spin. For example, the number of winning paylines may be cumulative based on the total number of paylines achieved during the free spins.

Figure 8:
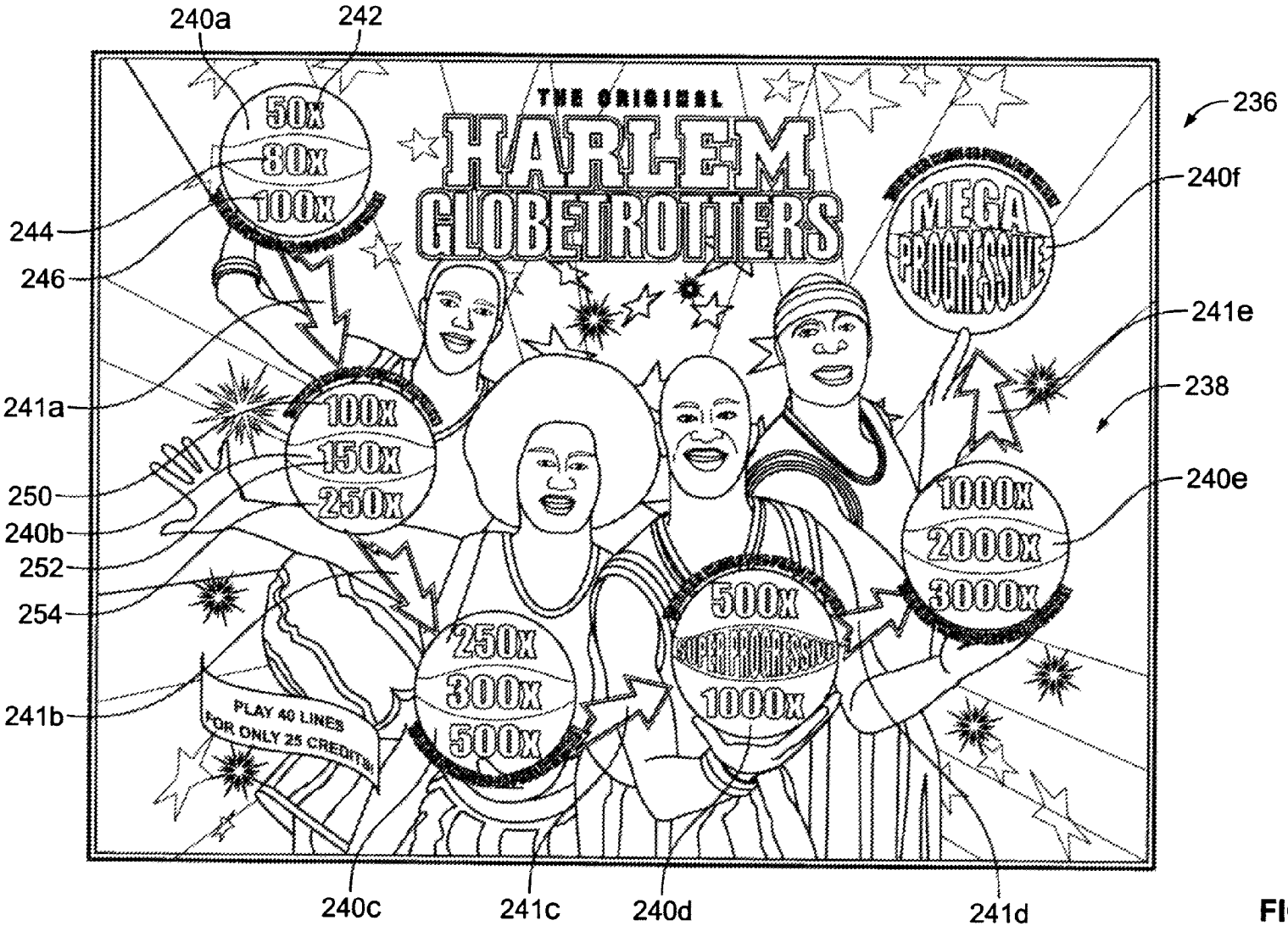
FIG. 8 is an illustration of a bonus pay table incorporating one embodiment of the present invention.

FIG. 8 shows one example of a top box bonus game screen 236. The top box bonus game screen 236 shows a top box bonus pay table 238 including various basketballs 240*a-f* separated by arrows 241*a-e*. Each of the basketballs 240*a-f* correspond with a different threshold of winning paylines.

According to the embodiment shown in FIG. 8, the basketballs 240*a-e* each have four selectable elements associated therewith: three award values and an arrow. The first basketball 240*a*, for example, corresponds with nineteen and twenty (19-20) winning paylines and includes a 50× multiplier 242, an 80× multiplier 244, and a 100× multiplier 246. The first basketball 240*a* also includes a first arrow 241*a* associated therewith. Likewise, the second basketball 240*b* corresponds with twenty-one and twenty-two (21-22) winning paylines and includes a 100× multiplier 250, a 150× multiplier 252, and a 250× multiplier 254. The second basketball 240*b* also includes a second arrow 241*b* associated therewith. The third, fourth, and fifth basketballs 240*c-e* similarly include three award values and an arrow 241*c-e* associated therewith. The sixth basketball 240*f* has a single award element—a Mega Progressive award value×associated therewith.

In other embodiments, more or less award values may be associated with each basketball 240*a-f*. Furthermore, although in the illustrated embodiment, the award values are multipliers, the award values may also include fixed credit amounts or the like. The top box bonus pay table 238 may also be displayed in any suitable manner and is not limited to the basketballs 240*a-f* shown in the illustrated embodiments.

As the threshold amounts of winning paylines increase, the award values (e.g., multipliers) associated therewith likewise increase. For example, as described above, the threshold amount of winning paylines associated with the first basketball 240*a* is nineteen to twenty (19-20), and the multipliers associated therewith are 50×, 80×, and 100×; the threshold amount of winning paylines associated with the second basketball 240*b* is twenty-one to twenty-two (21-22), and the multipliers associated therewith are 100×, 150×, and 250×; etc. As indicated by the sixth basketball 240*f*, if thirty-three (33) or more winning paylines are achieved, the player is awarded a Mega-Progressive, which is typically the highest possible award amount.

Referring back to FIGS. 6 and 7, because twenty winning paylines were achieved during the confetti bonus game, the first basketball 240*a* in the top box bonus feature is activated. Upon activation, each of the selectable elements (i.e., multipliers 242, 244, 246 and first arrow 241*a*) associated with the first basketball 240*a* may be highlighted (e.g., lit up), one at a time. The highlighting may be successive or random. In one embodiment, the highlighting may move quickly between the selectable elements at first and then gradually slow down until a final element is randomly selected. If the randomly selected element is a multiplier 242, 244, 246, the award associated with the outcome of the confetti bonus is multiplied by the corresponding amount (i.e., 50×, 80×, or 100×). If the randomly selected element is the arrow 241*a*, the top box bonus feature is activated with respect to the next basketball (the second basketball 240*b*), and the selectable elements (i.e., multipliers 250, 252, 254 and arrow 241*b*) of the second basketball 240*b* are highlighted one at a time until a final element is randomly selected. The bonus feature continues until a non-arrow selectable element is randomly selected, and the corresponding award is then awarded to the player.

Each of these embodiments and obvious variations thereof is contemplated as falling within the spirit and scope of the claimed invention, which is set forth in the following claims.

What is claimed is:

1. A gaming system comprising:

at least one display configured to display a plurality of symbol positions, the plurality of symbol positions being configured to display symbols indicative of a randomly selected outcome of a wagering game in relation to a plurality of paylines; and a controller configured to award an award for any winning paylines with a winning combination of the symbols occurring along the payline in the outcome of the wagering game, and to add a number of the winning paylines in the outcome of the wagering game to a counter configured to track a total number of winning paylines, wherein the controller is further configured, in response to the total number of winning paylines in the counter exceeding a predetermined threshold number of winning paylines, to activate a game feature in which a second award is awarded.

2. The gaming system of claim 1, wherein a size of the second award is related to the total number of winning paylines in the counter.

3. The gaming system of claim 1, wherein the second award is a multiplier.

4. The gaming system of claim 1, wherein the controller is further configured, in response to at least one predetermined triggering condition in the wagering game, to modify all of the symbols displayed on a cluster of adjacent ones of the symbol positions to display a common symbol thereby forming a modified array, to determine a number of winning paylines with a winning combination of the symbols occurring along one of the paylines in the modified array, and to add the number of winning paylines with a winning combination of the symbols in the modified array to the counter.

5. The gaming system of claim 1, wherein the gaming system is configured to display at least one pay table associated with the predetermined threshold number of winning paylines.

6. The gaming system of claim 5, wherein the at least one pay table includes a plurality of threshold numbers of winning paylines, at least one of the plurality of threshold numbers of winning paylines having more than one award value associated therewith.

7. The gaming system of claim 6, wherein the award is randomly selected from the more than one award value.

8. The gaming system of claim 1, wherein the counter is reset to zero prior to initiation of another wagering game.

9. A method of conducting a wagering game on a gaming system with at least one display device and at least one processor, the method comprising:

displaying, via the at least one display device, a first array of randomly selected symbols, the first array of randomly selected symbols forming an outcome in a wagering game;

evaluating, via the at least one processor, the first array of randomly selected symbols for a predetermined triggering condition;

displaying, via the at least one display device and in response to the occurrence of the predetermined triggering condition in the first array, a second array of symbols comprising a cluster of adjacent symbol positions each displaying a common symbol; and awarding an award associated with the amount of winning paylines occurring at least in association with the cluster of the common symbols.

10. The method of claim 9, wherein the second array of symbols comprises a modified subsection of the first array.

11. The method of claim 9, wherein the act of awarding comprises awarding an award associated with the number of winning paylines occurring in the first array and in the second array.

12. The method of claim 9, further comprising:

awarding a second award if the symbols in the first array form a winning outcome along at least one payline.

13. The method of claim 9, wherein the second array is a subsection of the first array modified such that each of the adjacent symbol positions in the subsection displays the same common symbol.

14. The method of claim 9, further comprising displaying at least one pay table associated with the predetermined amount of paylines.

15. The method of claim 9, wherein the common symbol displayed in each of the adjacent symbol positions of the cluster is a standard symbol.

16. The method of claim 14, wherein the at least one pay table includes a plurality of threshold amounts of winning paylines, at least one of the plurality of threshold amounts having more than one award value associated therewith.

17. The method of claim 16, wherein the act of awarding an award includes randomly selecting an award from the more than one award value.

18. A method of conducting a wagering game on a gaming system with at least one display device and at least one processor, the method comprising:

displaying, via the at least one display device, a plurality of reels having a plurality of standard symbols for indicating a randomly selected outcome of the wagering game, the plurality of reels forming an array of symbol positions;

determining, via the at least one processor, if a predetermined event occurred; and in response to the predetermined event, modifying a cluster of adjacent symbol positions within the array such that all of the symbol positions in the cluster include like standard symbols.

19. The method of claim 18, wherein the plurality of reels have both the plurality of standard symbols and at least one wild symbol.

20. The method of claim 18, wherein the plurality of reels have both the plurality of standard symbols and at least one bonus trigger.

21. A method of conducting a wagering game on a gaming system, the method comprising:

displaying an array of symbol positions configured to indicate a randomly selected outcome of the wagering game;

populating the plurality of symbol positions with symbols corresponding to the randomly selected outcome;

awarding an award if the symbols populating the array of symbol positions correspond to a winning outcome;

evaluating the array of symbol positions for a predetermined triggering condition;

modifying, in response to a satisfaction of the predetermined triggering condition, a plurality of symbols positions adjacent a selected symbol position to display a common symbol;

evaluating the modified array of symbol positions to determine a number winning of paylines indicated by the modified array; and awarding an award relating to the indicated number of paylines.

22. The method of claim 21, wherein the act of modifying comprises modifying a plurality of symbols adjacent a randomly selected symbol to display the common symbol.

23. The method of claim 21, wherein the award is a multiplier.

24. The method of claim 21, wherein the act of modifying comprises modifying a cluster of symbols adjacent a randomly selected symbol to display a common symbol.

* * * * *